US005372778A

United States Patent [19]

Yahagi et al.

[11] Patent Number: 5,372,778

[45] Date of Patent: Dec. 13, 1994

[54] ELECTROMAGNETIC STAINLESS STEEL

[75] Inventors: Shinichiro Yahagi, Oobu; Akihiko Saito, Nagoya, both of Japan

[73] Assignee: Daido Tokushuko Kabushiki Kaisha, Nagoya, Japan

[21] Appl. No.: 163,705

[22] Filed: Dec. 9, 1993

[30] Foreign Application Priority Data

Dec. 11, 1992 [JP] Japan ..... 4-331867
Nov. 10, 1993 [JP] Japan ..... 5-281274

[51] Int. Cl.[5] ..... C22C 38/06; C22C 38/18
[52] U.S. Cl. ..... 420/41; 420/84
[58] Field of Search ..... 420/41, 84

[56] References Cited

FOREIGN PATENT DOCUMENTS 57-110656 7/1982 Japan ..... 420/41

*Primary Examiner*—Deborah Yee
*Attorney, Agent, or Firm*—Sughrue, Mion, Zinn, Macpeak & Seas

[57] ABSTRACT

An electromagnetic stainless steel consists essentially of not more than 0.015 wt % of C, not more than 3.0 wt % of Si, not more than 0.5 wt % of Mn, not more than 0.030 wt % of P, not more than 0.030 wt % of S, 4–20 wt % of Cr, 0.2–7.0 wt % of Al, 0.02–0.50 wt % of Bi and the remainder being Fe and inevitable impurity and has excellent magnetic properties, electric resistance, cold forgeability and machinability.

5 Claims, No Drawings

ELECTROMAGNETIC STAINLESS STEEL

BACKGROUND OF THE INVENTION

1. Field of the Invention

This invention relates to electromagnetic stainless steels usable for use in iron core for electromagnetic valve, iron core for relay, magnetic shield, yoke and the like, and more particularly to an electromagnetic stainless steel having improved magnetic properties and electric resistance in ferritic electromagnetic stainless steel and excellent cold forgeability and machinability.

2. Description of the Related Art

From the old time, chromium-iron stainless steels are known as a corrosion-resistant material. And also, 13Cr steel, 18Cr steel and the like are mainly and widely used as a ferritic stainless steel in a field of magnetic materials requiring the corrosion resistance.

Concretely, the corrosion-resistant soft magnetic materials comprised of the above electromagnetic stainless steel are frequently used as an iron core of electromagnetic valve, iron core of relay and other electromagnetic materials used under corrosion environment, or as a magnetic shield material incorporated in an electric part such as a shield plate for casette tape recorder, shield material for power transformer and the like.

In the conventional electromagnetic stainless steel, it is desirable that the cold forgeability and machinability are improved while maintaining the corrosion resistance from a viewpoint that the electromagnetic stainless steel as a raw material is finished into a given shape by cold plastic working and cutting.

Furthermore, it is particularly desirable to improve the magnetic properties and electric resistance in the applications of the electromagnetic stainless steel in addition to the improvement of cold forgeability and machinability.

In this type of the electromagnetic stainless steel, therefore, it is demanded to improve not only the cold forgeability and machinability but also the magnetic properties and electric resistance.

SUMMARY OF THE INVENTION

It is, therefore, an object of the invention to solve the above problem and to provide an electromagnetic stainless steel having good magnetic properties and electric resistance and excellent cold forgeability and machinability.

According to the invention, there is the provision of an electromagnetic stainless steel consisting essentially of not more than 0.015 wt % of C, not more than 3.0 wt % of Si, not more than 0.5 wt % of Mn, not more than 0.030 wt % of P, not more than 0.030 wt % of S, 4–20 wt % of Cr, 0.2–7.0 wt % of Al, 0.02–0.50 wt % of Bi and the remainder being Fe and inevitable impurity, which has improved magnetic properties and electric resistance and more improved cold forgeability and machinability while maintaining an effective corrosion resistance.

In a preferable embodiment of the invention, at least one of not more than 1.0 wt % of Nb, not more than 1.0 wt % of Ti, not mroe than 1.0 wt % of Zr and not more than 1.0 wt % of V is included, whereby the cold forgeability may be further improved.

In another preferable embodiment of the invention, at least one of not more than 2.0 wt % of Cu, not more than 3.0 wt % of Ni and not more than 5.0 wt % of Mo is included, whereby the corrosion resistance may be further improved.

In the other preferable embodiment of the invention, at least one of 0.01–0.30 wt % of Pb, 0.002–0.200 wt % of Ca, 0.01–0.20 wt % of Te and 0.01–0.30 wt % of Se is included, whereby the machinability may be further improved.

DESCRIPTION OF THE PREFERRED EMBODIMENTS

The reason why the chemical composition (wt %) in the electromagnetic stainless steel according to the invention is limited to the above range is mentioned as follows.

At first, Cr as a main alloying ingredient in the electromagnetic stainless steel according to the invention is an effective element giving the corrosion resistance and also increasing the electric resistance. However, when the amount of Cr exceeds 20 wt %, the increase of the electric resistance is not observed and the economical merit is undesirably degraded. On the other hand, the lower limit of Cr is effective to be 4 wt % from a viewpoint of the corrosion resistance because when the amount of Cr is too small, it is difficult to develop the effective corrosion resistance. Therefore, the amount of Cr added is within a range of 4–20 wt %, desirably 8–16%. Thus, the magnetic properties, particularly saturated magnetic flux density ($B_{30}$) is effectively maintained.

Further, Al as a main alloying ingredient is an effective element increasing the electric resistance and also improves the magnetic properties (coercive force (Hc) is reduced), so that the amount of not less than 0.2 wt % is required. However, when it exceeds 7.0 wt %, the cold forgeability is degraded, so that the upper limit should be 7.0 wt %. Therefore, the amount of Al added is within the range of 0.2–7.0%, desirably 0.3–5.0%, more desirably 0.4–3.5%. Thus, the electric resistance of the electromagnetic stainless steel is effectively improved.

Then, Si is an effective element increasing the electric resistance likewise Cr and Al. That is, the electric resistance is increased as the amount of Si in the stainless steel increases. On the other hand, Si is an effective element improving the magnetic properties or reducing the coercive force (Hc), so that the amount of Si is desirable to be not less than 0.01 wt %. However, when it exceeds 3.0 wt %, the cold forgeability is degraded, so that the upper limit should be 3.0 wt %. Therefore, the amount of Si added is within the range of desirably 0.01–3.0%, more desirably 0.02–2.0%.

Bi is an element causing no problem in environmental hygiene. When the use of Pb is unfavorable from a viewpoint of the environmental hygiene, it is effective to add Bi as an element for improving the machinability. When Bi is added in an amount of not less than 0.02 wt % as a harmless element for the improvement of the machinability, the electric resistance is increased without lowering the magnetic properties and the machinability may be improved. In order to more stably improve the machinability, the amount of 0.30 wt % or more may be preferable. However, when the amount is too large, the cold forgeability and magnetic properties are degraded and also the hot workability is lowered or degraded, so that the upper limit should be 0.50 wt %. Therefore, the amount of Bi added is within the range of 0.02–0.50%, desirably 0.30–0.45%.

And also, C is inevitably included in the production of the electromagnetic stainless steel, but degrades the magnetic properties, toughness and cold forgeability, so that the upper limit should be 0.015 wt %.

Further, P, N and S degrade the cold forgeability. Particularly, N and S are elements badly affecting the magnetic properties. Therefore, it is necessary to adjust the amounts of P, S and N so that P is not more than 0.030 wt %, S is not more than 0.030 wt % and N is not more than 300 ppm.

Thus, the amounts of C, N and S in stainless steel are decreased to lower the coercive force of the electromagnetic stainless steel, whereby the magnetic properties are improved.

Moreover, Mn is an element necessarily including in the produciton step of the electromagnetic stainless steel likewise C and acts to improve the lowering of the hot workability produced when the amount of Bi is more than 0.30 wt %. In this case, the amount of Mn is desirable to be not less than 0.10 wt %, preferably 0.20 wt % or more. However, when the amount is too large, the cold forgeability of the stainless steel is degraded, so that the upper limit should be 0.5 wt %.

In addition, O produces an oxide inclusion to considerably degrade the cold forgeability of the stainless steel, so that is is desirable to adjust the amount of O to not more than 100 ppm, preferably not more than 50 ppm. Particularly, by decreasing the oxygen amount as mentioned above, the coercive force (Hc) is lowered to improve the magnetic properties and the cold forgeability.

As a selective element, Nb, Ti, Zr and V are elements improving the toughness and magnetic properties and considerably improving the cold forgeability of the stainless steel. It is desirable to add Nb of not less than 0.001 wt %, Ti of not less than 0.001 wt %, Zr of not less than 0.001 wt % and V of not less than 0.001 wt %. However, when these elements are added in a great amount, the magnetic properties are degraded and also the cold forgeability is obstructed, so that the upper limit of each of these elements should be 1.0 wt %. These elements may be added alone or a mixture within the above range.

As another selective element, Cu, Ni and Mo can effectively improve the corrosion resistance of the stainless steel, so that it is desirable that the amount of Cu is not less than 0.01 wt % but not more than 2.0 wt %, the amount of Ni is not less than 0.01 wt % but not more than 3.0 wt % and the amount of Mo is not less than 0.01 wt % but not more than 5.0 wt %.

Further, Pb, Ca, Te and Se are elements effectively improving the machinability as a selective element and may be added in order to more improve the machinability in the electromagnetic stainless steel. These elements are added within a range not damaging the cold forgeability and magnetic properties alone or in admixture. Concretely, the amount of Pb is 0.01–0.30 wt %, the amount of Ca is 0.002–0.200 wt %, the amount of Te is 0.01–0.20 wt % and the amount of Se is 0.01–0.30 wt %. In the electromagnetic stainless steel according to the invention, the remainder is substantially Fe and contains inevitalbe impurity.

The electromagnetic stainless steel according to the invention has the chemical composition as mentioned above, so that not only the magnetic properties and electric resistance but also the cold forgeability and machinability are improved. Particularly, the problem in environmental hygiene apt to be caused in the addition of Pb is avoided by adding Bi as an element for improving the machinability.

The following example is given in illustration of the invention and is not intended as limitation thereof.

Various specimens are prepared by melting chromium-iron alloys having chemical compositions shown in Tables 1 to 5 (remainder being Fe and inevitable impurities), casting into given ingots and then subjecting to hot working according to usual manner.

TABLE 1

| | Chemical composition (wt % provided that N,O are ppm) | | | | | | | | | | | | |
|---|---|---|---|---|---|---|---|---|---|---|---|---|---|
| Division | C | Si | Mn | P | S | Cr | Al | Bi | N | O | Nb, Ti, Zr, V | Cu, Ni, Mo | Pb, Ca, Te, Se |
| Invention steel | | | | | | | | | | | | | |
| 1 | 0.007 | 1.10 | 0.20 | 0.022 | 0.016 | 10.0 | 1.50 | 0.15 | 200 | 70 | — | — | — |
| 2 | 0.012 | 0.85 | 0.15 | 0.025 | 0.005 | 13.2 | 0.25 | 0.20 | 150 | 80 | — | — | — |
| 3 | 0.011 | 0.04 | 0.21 | 0.021 | 0.002 | 15.0 | 3.00 | 0.07 | 120 | 65 | Nb: 0.05<br>Zr: 0.01 | — | — |
| 4 | 0.005 | 0.65 | 0.01 | 0.001 | 0.007 | 5.5 | 4.50 | 0.05 | 90 | 20 | — | Cu: 0.50<br>Mo: 0.30 | — |
| 5 | 0.007 | 2.90 | 0.30 | 0.029 | 0.021 | 17.0 | 1.10 | 0.07 | 110 | 90 | — | Ni: 0.09 | Pb: 0.05 |

TABLE 2

| | Chemical composition (wt % provided that N,O are ppm) | | | | | | | | | | | | |
|---|---|---|---|---|---|---|---|---|---|---|---|---|---|
| Division | C | Si | Mn | P | S | Cr | Al | Bi | N | O | Nb, Ti, Zr, V | Cu, Ni, Mo | Pb, Ca, Te, Se |
| Invention steel | | | | | | | | | | | | | |
| 6 | 0.008 | 0.90 | 0.09 | 0.015 | 0.009 | 12.5 | 0.30 | 0.10 | 140 | 90 | Ti: 0.05 | — | Ca: 0.02 |
| 7 | 0.005 | 0.75 | 0.08 | 0.009 | 0.008 | 12.8 | 0.31 | 0.03 | 110 | 50 | Ti: 0.01<br>V: 0.02 | Cu: 0.20<br>Ni: 0.20 | Te: 0.02<br>Se: 0.02 |
| 8 | 0.007 | 0.01 | 0.07 | 0.008 | 0.009 | 13.5 | 2.50 | 0.08 | 120 | 70 | Ti: 0.01<br>Nb: 0.01<br>Zr: 0.01 | Mo: 0.50<br>Ni: 0.50 | Pb: 0.01<br>Ca: 0.05 |
| 9 | 0.006 | 1.50 | 0.05 | 0.009 | 0.011 | 19.0 | 0.20 | 0.30 | 60 | 15 | — | — | Ca: 0.01 |
| 10 | 0.005 | 1.10 | 0.06 | 0.003 | 0.003 | 18.0 | 2.90 | 0.10 | 30 | 40 | V: 0.02<br>Nb: 0.06 | Ni: 0.20<br>Cu: 0.10<br>Mo: 0.50 | Te: 0.05<br>Se: 0.03 |

TABLE 3

| Division | Chemical composition (wt % provided that N,O are ppm) | | | | | | | | | | | | |
|---|---|---|---|---|---|---|---|---|---|---|---|---|---|
| | C | Si | Mn | P | S | Cr | Al | Bi | N | O | Nb, Ti, Zr, V | Cu, Ni, Mo | Pb, Ca, Te, Se |
| Invention steel | | | | | | | | | | | | | |
| 11 | 0.008 | 0.01 | 0.45 | 0.001 | 0.002 | 12.8 | 1.51 | 0.25 | 100 | 60 | — | — | — |
| 12 | 0.011 | 0.07 | 0.31 | 0.002 | 0.003 | 7.8 | 2.50 | 0.45 | 60 | 10 | — | — | — |
| 13 | 0.013 | 0.12 | 0.36 | 0.001 | 0.005 | 10.5 | 6.80 | 0.31 | 150 | 70 | — | — | — |
| 14 | 0.014 | 0.02 | 0.39 | 0.003 | 0.007 | 13.5 | 1.01 | 0.36 | 120 | 80 | — | — | — |
| 15 | 0.009 | 0.01 | 0.10 | 0.001 | 0.003 | 13.4 | 0.34 | 0.40 | 90 | 60 | V: 0.05 | Ni: 0.02<br>Mo: 0.02 | Ca: 0.02<br>Se: 0.03 |

TABLE 4

| Division | Chemical composition (wt % provided that N,O are ppm) | | | | | | | | | | | | |
|---|---|---|---|---|---|---|---|---|---|---|---|---|---|
| | C | Si | Mn | P | S | Cr | Al | Bi | N | O | Nb, Ti, Zr, V | Cu, Ni, Mo | Pb, Ca, Te, Se |
| Invention steel | | | | | | | | | | | | | |
| 16 | 0.007 | 0.80 | 0.10 | 0.011 | 0.003 | 12.5 | 0.35 | 0.50 | 110 | 70 | Nb: 0.06 | Cu: 0.30 | — |
| 17 | 0.008 | 0.56 | 0.15 | 0.008 | 0.001 | 13.1 | 0.40 | 0.45 | 90 | 50 | Ti: 0.05 | — | Pb: 0.08 |
| 18 | 0.015 | 0.01 | 0.01 | 0.003 | 0.001 | 13.4 | 0.55 | 0.03 | 80 | 90 | Nb: 0.90<br>V: 0.90 | Ni: 2.90<br>Mo: 0.90 | — |
| 19 | 0.002 | 0.02 | 0.03 | 0.005 | 0.002 | 12.9 | 0.29 | 0.09 | 100 | 10 | Ti: 0.90 | Cu: 1.90 | Ca: 0.19<br>Te: 0.18 |
| 20 | 0.005 | 0.01 | 0.01 | 0.003 | 0.003 | 13.9 | 0.31 | 0.02 | 50 | 40 | Zr: 0.80 | Mo: 4.80 | Pb: 0.29<br>Se: 0.28 |

TABLE 5

| Division | Chemical composition (wt % provided that N,O are ppm) | | | | | | | | | | |
|---|---|---|---|---|---|---|---|---|---|---|---|
| | C | Si | Mn | P | S | Cr | Al | Bi | N | O | others |
| Comparative steel | | | | | | | | | | | |
| 21 | 0.008 | 0.05 | 0.10 | 0.011 | 0.004 | 12.8 | 1.50 | — | 150 | 60 | — |
| 22 | 0.007 | 0.11 | 0.07 | 0.008 | 0.007 | 3.6 | 2.01 | — | 120 | 80 | — |
| 23 | 0.009 | 4.50 | 0.05 | 0.006 | 0.008 | 10.0 | 0.05 | 0.05 | 80 | 70 | — |
| 24 | 0.009 | 0.07 | 0.08 | 0.008 | 0.007 | 12.6 | 0.98 | 0.04 | 60 | 260 | — |
| 25 | 0.008 | 0.06 | 0.08 | 0.009 | 0.005 | 21.0 | 0.50 | 0.03 | 50 | 60 | — |
| 26 | 0.007 | 0.05 | 0.02 | 0.004 | 0.003 | 10.8 | 0.50 | 1.00 | 70 | 80 | — |

Then, the cold forgeability, corrosion resistance, machinability, coercive force (Hc), electric resistance ($\rho$) and magnetic properties (magnetic flux density: $B_{30}$) are measured with respect to these obtained specimens. and machinability are evaluated according to test methods shown in Table 6 and represented by symbols shown in the Table 6.

The measured results are shown in Tables 7 to 11.

TABLE 6

| Properties | Test method | Evaluation | | | |
|---|---|---|---|---|---|
| | | ◎ | ○ | Δ | X |
| Cold forgeability | Restrained cold forge upsetting test (Test sample: 14 mmϕ × 21 mml) | good | small cracking | partly cracking | cracked |
| Corrosion resistance | Exposure test in air | no rust | slight rust | rusting | red rust |
| Machinability | Drilling test (number of specimens drilled per drill of 2 mmϕ) | 120~81 specimens | 80~51 specimens | 50~21 specimens | 20 not more than 20 specimens |

In this case, the cold forgeability, corrosion resistance

TABLE 7

| Division | Cold forgeability | Corrosion resistance | machinability | Coercive force [Hc (Oe)] | Electric resistance [μΩ · cm] | magnetic flux density [$B_{30}$ (kG)] |
|---|---|---|---|---|---|---|
| Invention steel | | | | | | |
| 1 | ○ | ○ | ◎ | 1.9 | 84 | 13.5 |
| 2 | ○ | ◎ | ◎ | 1.6 | 69 | 13.3 |
| 3 | ◎ | ◎ | ○ | 2.1 | 95 | 12.8 |
| 4 | ○ | ○ | ○ | 1.7 | 101 | 13.9 |
| 5 | ○ | ◎ | ◎ | 1.3 | 106 | 12.4 |

TABLE 8

| Division | Cold forgeability | Corrosion resistance | machinability | Coercive force [Hc (Oe)] | Electric resistance [μΩ · cm] | magnetic flux density [$B_{30}$ (kG)] |
|---|---|---|---|---|---|---|
| Invention steel | | | | | | |
| 6 | ○ | ○ | ○ | 1.6 | 69 | 13.5 |
| 7 | ○ | ◎ | ○ | 1.5 | 65 | 13.6 |
| 8 | ◎ | ◎ | ○ | 1.9 | 101 | 12.9 |
| 9 | ○ | ◎ | ◎ | 1.6 | 85 | 11.6 |
| 10 | Δ | ◎ | ◎ | 1.8 | 119 | 11.4 |

TABLE 9

| Division | Cold forgeability | Corrosion resistance | machinability | Coercive force [Hc (Oe)] | Electric resistance [μΩ · cm] | magnetic flux density [$B_{30}$ (kG)] |
|---|---|---|---|---|---|---|
| Invention steel | | | | | | |
| 11 | ◎ | ○ | ◎ | 0.9 | 85 | 13.2 |
| 12 | ○ | ○ | ◎ | 1.1 | 74 | 13.9 |
| 13 | ○ | ○ | ◎ | 1.2 | 115 | 11.9 |
| 14 | ◎ | ○ | ◎ | 1.6 | 78 | 13.4 |
| 15 | ◎ | ○ | ◎ | 1.1 | 55 | 13.8 |

TABLE 10

| Division | Cold forgeability | Corrosion resistance | machinability | Coercive force [Hc (Oe)] | Electric resistance [μΩ · cm] | magnetic flux density [$B_{30}$ (kG)] |
|---|---|---|---|---|---|---|
| Invention steel | | | | | | |
| 16 | ○ | ○ | ◎ | 0.9 | 71 | 13.2 |
| 17 | ○ | ○ | ◎ | 0.8 | 69 | 13.4 |
| 18 | ○ | ◎ | ○ | 0.9 | 60 | 13.5 |
| 19 | ○ | ◎ | ◎ | 0.6 | 58 | 13.8 |
| 20 | ○ | ◎ | ◎ | 0.7 | 60 | 13.6 |

TABLE 11

| Division | Cold forgeability | Corrosion resistance | machinability | Coercive force [Hc (Oe)] | Electric resistance [μΩ · cm] | magnetic flux density [$B_{30}$ (kG)] |
|---|---|---|---|---|---|---|
| Comparative steel | | | | | | |
| 21 | Δ | ○ | X | 2.2 | 70 | 12.9 |
| 22 | ○ | X | X | 2.1 | 54 | 14.0 |
| 23 | X | Δ | Δ | 1.8 | 101 | 12.5 |
| 24 | X | Δ | Δ | 3.2 | 64 | 12.8 |
| 25 | X | ◎ | Δ | 2.1 | 74 | 10.8 |
| 26 | X | Δ | ◎ | 1.9 | 54 | 13.4 |

As seen from the results of Tables 7 to 11, the steel specimen Nos. 1–20 according to the invention are low in the coercive force (Hc), high in the magnetic flux density ($B_{30}$) and considerably excellent in the cold forgeability. Further, these specimens are satisfactory in the corrosion resistance and excellent in the machinability and electric resistance. Moreover, when the amount of Bi exceeds 0.30 wt %, the improvement of the machinability can stably be obtained, and the hot workability apt to be degraded by addition of Bi can be improved by adding Mn in an amount not exceeding the upper limit.

On the contrary, the comparative steel specimen No. 21 is poor in the machinability because it does not contain the element for improving the machinability. In the comparative steel specimen No. 22, the corrosion resistance is poor because of low Cr amount, and also the machinability is poor due to the absence of element for improving the machinability. In the comparative steel specimen No. 25, the cold forgeability is poor because the Si amount is too large. In the comparative steel specimen No. 24, the cold forgeability and coercive force are poor because the O amount is too large. In the comprative steel specimen No. 25, the cold forgeability is poor and the magnetic flux density is low because the Cr amount is too large. In the comparative steel No. 26, the machinability is excellent, but the cold forgeability is poor because the Bi amount as an element for improving the machinability is too large, from which it is apparent that a care should be taken in the addition of the element for improving the machinability.

As mentioned above, the electromagnetic stainless steels according to the invention have excellent cold forgeability, improved magnetic properties and electric resistance and effetive corrosion resistance, so that they are advantageously used as a material for cold forging particularly applied to corrosion enviornment. Furthermore, the machinability may be more improved by adding Bi as an element for the improvement of machinability, which can develop a considerably excellent effect of avoiding the problem in environmental hygiene apt to be caused due to the addition of Pb.

What is claimed is:

1. An electromagnetic stainless steel consisting essentially of not more than 0.015 wt % of C, not more than 3.0 wt % of Si, not more than 0.5 wt % of Mn, not more than 0.030 wt % of P, not more than 0.030 wt % of S, 4–20 wt % of Cr, 0.2–7.0 wt % of Al, 0.02–0.50 wt % of Bi and the remainder being Fe and inevitalbe impurity.

2. An electromagnetic stainless steel according to claim 1, wherein said steel further contains at least one of not more than 1.0 wt % of Nb, not more than 1.0 wt % of Ti, not more than 1.0 wt % of Zr and not more than 1.0 wt % of V.

3. An electromagnetic stainless steel according to claim 1, wherein said steel further contains at least one of not more than 2.0 wt % of Cu, not more than 3.0 wt % of Ni and not more than 5.0 wt % of Mo.

4. An electromagnetic stainless steel according to claim 1, wherein said steel further contains at least one of 0.01–0.30 wt % of Pb, 0.002–0.200 wt % of Ca, 0.01–0.20 wt % of Te and 0.01–0.30 wt % of Se.

5. An electromagnetic stainless steel according to claim 1, wherein N and O in said steel are regulated to not more than 300 ppm and not more than 100 ppm, respectively.

* * * * *